US005438777A

United States Patent [19]

Howell

[11] Patent Number: 5,438,777

[45] Date of Patent: Aug. 8, 1995

[54] PICTURE FRAME WITH PICTURE HOLDER SECURED BY TWO-SIDED TAPE

[76] Inventor: David Howell, 333 Hook Rd., Katonah, N.Y. 10536

[21] Appl. No.: 62,062

[22] Filed: May 14, 1993

Related U.S. Application Data

[63] Continuation-in-part of Ser. No. 919,206, Jul. 24, 1992, Pat. No. 5,199,200.

[51] Int. Cl.[6] ..... G09F 1/12

[52] U.S. Cl. ..... 40/152.1; 40/154; 40/159

[58] Field of Search ..... 40/152.1, 159, 594, 40/154

[56] References Cited

U.S. PATENT DOCUMENTS

| | | | |
|---|---|---|---|
| 2,636,702 | 4/1953 | Brody | 40/152.1 X |
| 3,540,146 | 11/1970 | Watkins | 40/152.1 |
| 3,837,987 | 9/1974 | Williams et al. | 40/159 X |
| 4,905,389 | 3/1990 | Bisconti | 40/152.1 |
| 5,253,439 | 10/1993 | Shanok et al. | 40/594 X |

*Primary Examiner*—Brian K. Green
*Attorney, Agent, or Firm*—Trapani & Molldrem

[57] ABSTRACT

A picture frame has a front frame member, with a central picture opening. A cast zinc one-piece picture holder is secured to the frame member with double-sided tape.

7 Claims, 3 Drawing Sheets

PICTURE FRAME WITH PICTURE HOLDER SECURED BY TWO-SIDED TAPE

This is a continution in part of my application Ser. No. 07/919,206, filed Jul. 24, 1992, now U.S. Pat. No. 5,199,200.

BACKGROUND OF THE INVENTION

This invention relates to decorative display devices, such as picture frames, and is more particularly concerned with a novel combination with frame elements.

Frame construction for a picture, poster, art work, or other two dimensional subject traditionally comprises four frame elements which hold the artwork sandwiched between a front glass plate and a frame back. While many frames have been embellished with carvings, moldings, and the like, the embellishments tend to be surface features or features carved or molded directly into the frame elements.

No one has previously achieved a simple, straightforward frame design by constructing a frame in which a picture holder is secured by double sided tape to a frame front.

OBJECTS AND SUMMARY OF THE INVENTION

Accordingly, it is an object of this invention to provide a picture frame of novel construction.

It is also an object of this invention to provide an improved picture frame of elegantly simple construction, combining the attributes of both beauty and ruggedness.

According to one aspect of this invention, a picture frame has a front frame member with a margin that surrounds a picture opening.

A picture holder member is secured onto the back of the front frame member, at its picture opening. The picture holder member is adapted to receive the displayed picture or art work, which can be sandwiched between a front glass plate and a rear frame back or similar member. In a preferred embodiment, the picture holder includes a one-piece casting e.g. of zinc or zinc alloy. This picture holder has a rectangular front member which has a front flat surface, and a retaining wall formed on three sides of the rectangular member, with a fourth side being open to receive the picture, the associated glass plate, and the backing members. Also in a preferred embodiment, the one-piece casting is secured onto the back grid member with double-sided tape, that is, tape which has adhesive on both surfaces to bond the picture holder to the front frame member. The margin that defines the opening in the frame member is somewhat wider than the picture holder casting. Thus, this margin of the front frame member serves as a front retaining member to hold the glass and picture in place within the picture holder.

The above and many other objects, features, and advantages of this invention will be described in detail with reference to the preferred embodiment, which should be read in conjunction with the accompanying Drawing.

DETAILED DESCRIPTION OF THE PREFERRED EMBODIMENT

Figure 1:
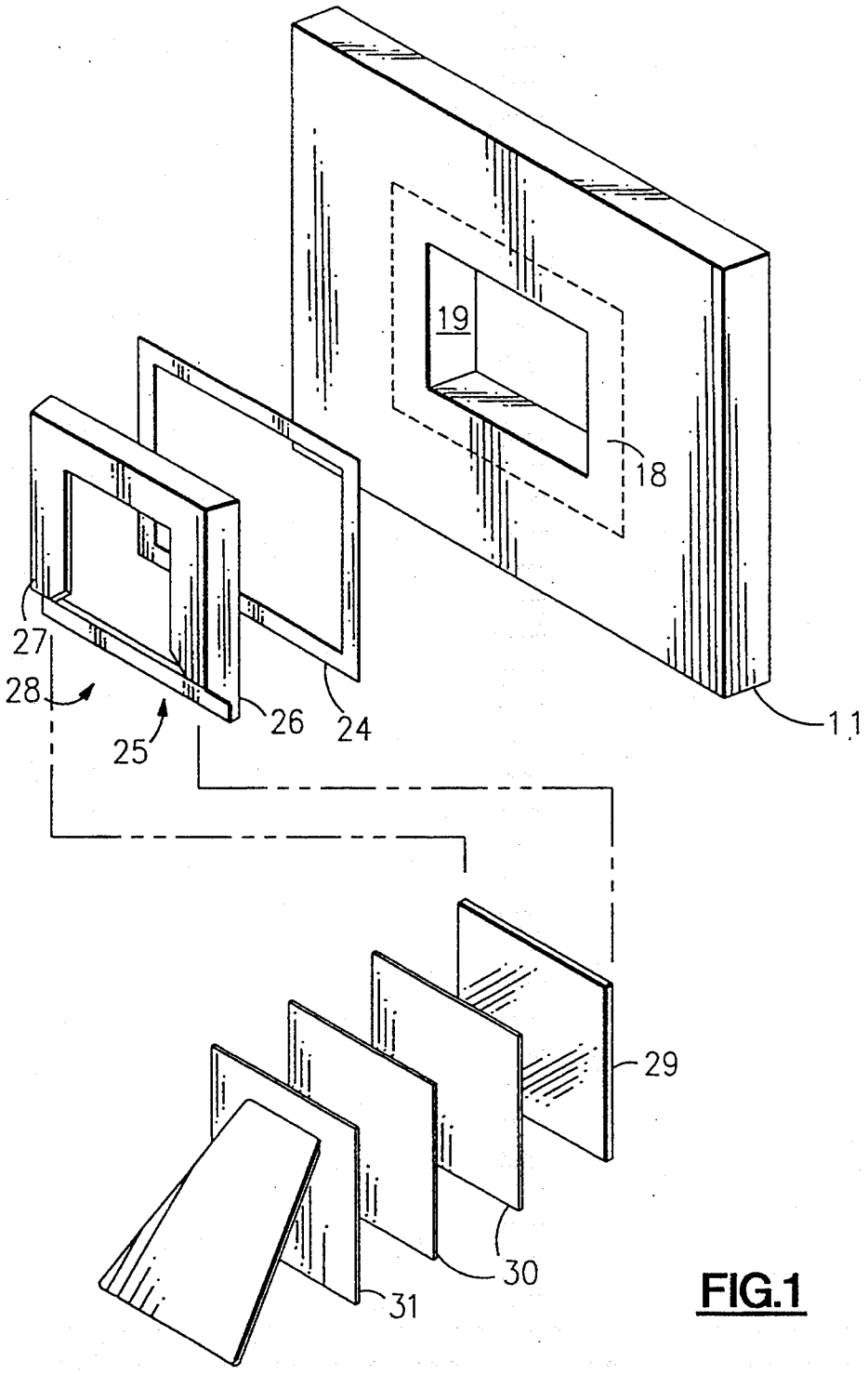
FIG. 1 is an exploded perspective assembly view of a picture frame according to one preferred embodiment of this invention.
Figure 4:
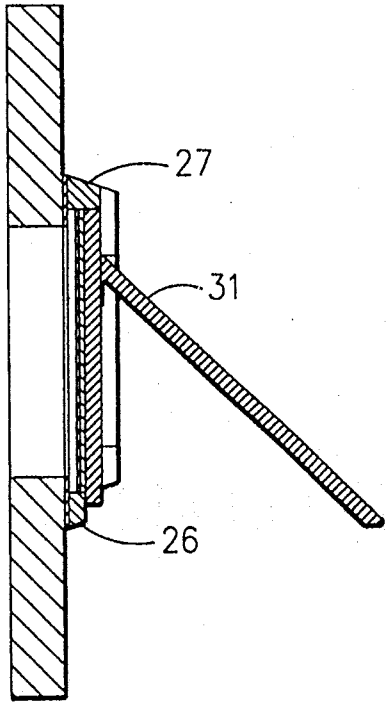
FIG. 4 is a sectional elevation of this embodiment.
Figure 3:
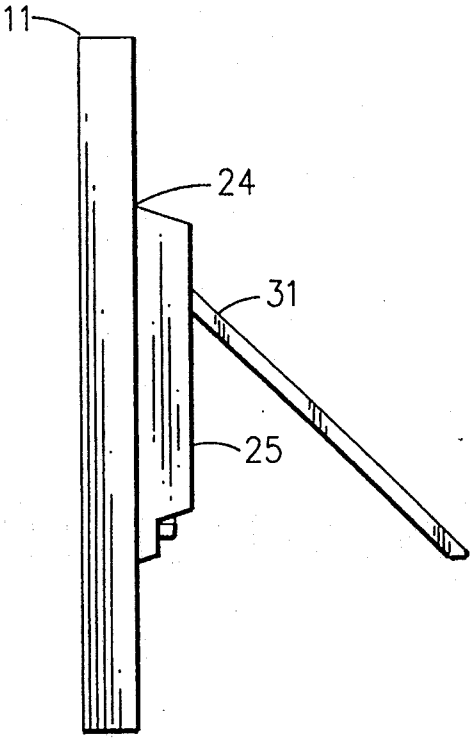
FIG. 3 is a side elevation of this embodiment.
Figure 2:
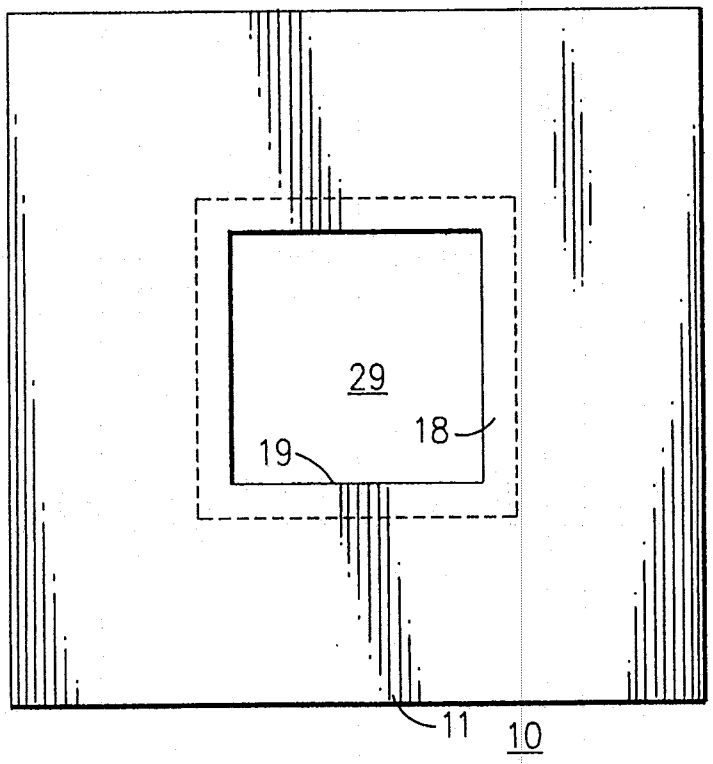
FIG. 2 is a front elevation of the picture frame of this embodiment.

With reference to the Drawing, and specifically to FIGS. 1–4, a picture frame 10 constructed according to this invention is shown to have a rectangular front frame member 11. At the center of the frame member 11 there is a picture opening 19.

A series of lengths of double-sided adhesive tape 24 arranged in a rectangle is applied to the proximal side of the frame member 11 on a margin area 18 around the picture opening 19. The double-sided tape rectangle 24 can be formed of separate strips, or can be die-cut in the appropriate shape. Then, a one-piece picture holder member 25 is secured by this square or other suitable rectangle of double-sided tape 24 to the frame member 11.

Figure 5:
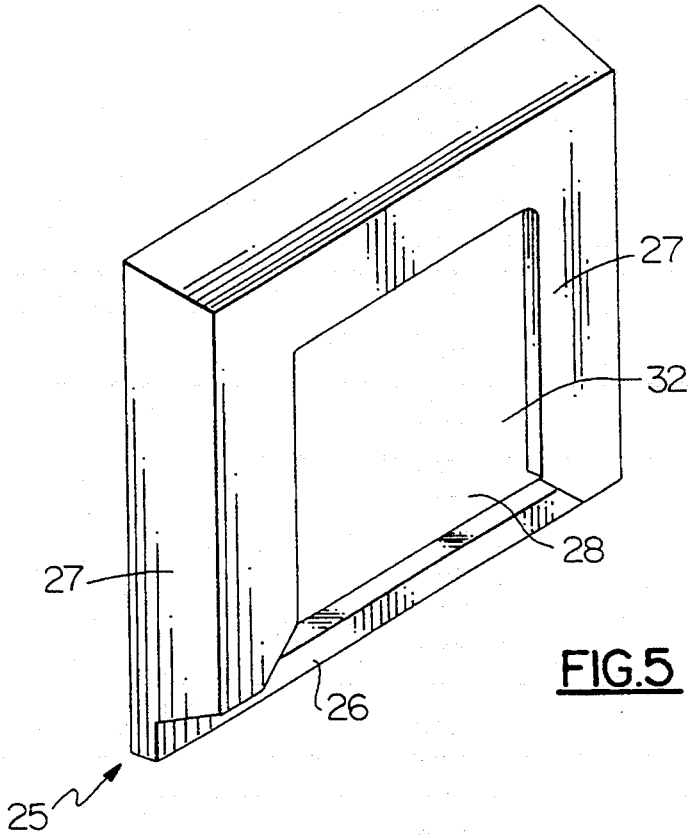
FIGS. 5 and 6 are back and front perspective views of the picture holder element of this embodiment.
Figure 6:
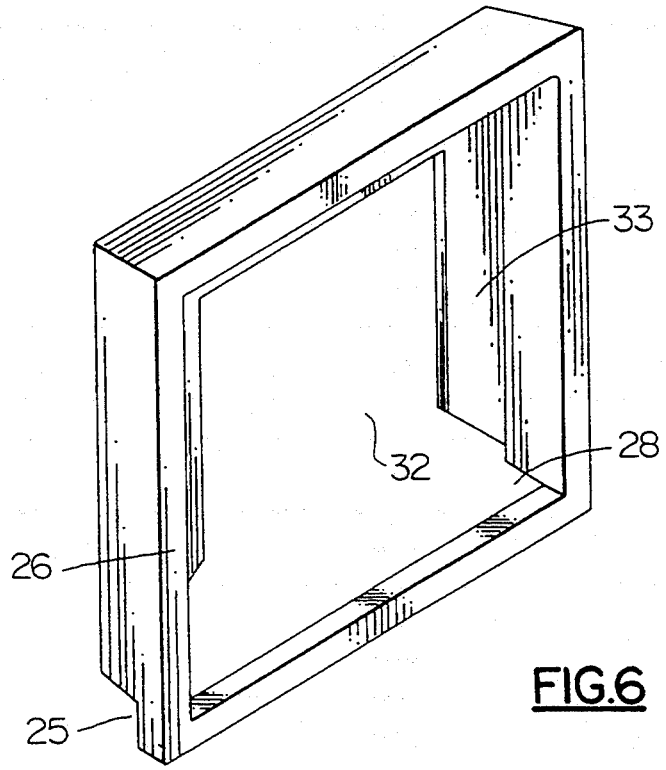

The picture holder member 25 is preferably formed as a casting of zinc or zinc alloy, although it is equally possible to be molded of a synthetic resin material. The casting has a front or distal rectangle plate member 26 as shown in FIGS. 5 and 6, with a flat front or distal surface which is secured by the tape 24 to the margin 18. There is also a proximal retaining wall 27 which overhangs on three sides, leaving an open fourth side 28, here disposed downwards. A glass plate 29, one or more backing pads 30, and a frame back 31, here with an easel stand, are inserted through the open side 28 and retained in the picture holder member 25.

As further shown in FIGS. 5 and 6, the retaining wall 27 has three slanted sides and a generally axially extending proximal wall which defines an opening or slot 32 which receives the glass 29, the backing pads 30, the frame back 31, and any artwork or picture. The front member 26 defines a rectangular opening 33 at the front or distal side of the picture holder member 25. This opening 33 is somewhat larger than the picture opening 19 so that a portion of the frame member 11 extends over the edges towards the center of the opening 33. Thus, the margin area 18 of the frame member 11 serves as a front wall to retain the glass 29 and other elements within the picture holder member.

The picture frame of this invention can now be seen to be of a relatively simple construction. The frame member 11 can be laser cut of a decorative sheet metal or of wood, or can be die cut, or can be molded of a plastic material, if desired. The picture holder member 25, here die cast of zinc or zinc alloy, is of one piece construction and can be easily manufactured. Alternatively, this picture holder member can be molded of a synthetic resin, or can be constructed of other suitable materials.

The adhesive bond to each of the frame member 11 and the picture holder member 25 is actually stronger than the medium or substrate of the tape 24. This means that, in practice, the foam double-sided tape does not give way. If there is a failure, it is the foam or other substrate of the tape that parts, leaving the frame undamaged. This makes repair rather simple, being a matter of scraping the tape residue and replacing it with a similar rectangle 24 of double-sided tape.

While the invention has been described in detail with respect to a preferred embodiment and a few selected variants thereof, it should be understood that the invention is not limited to such embodiments. Rather, many modifications and variations would present themselves to those of skill in the art without departing from the scope and spirit of this invention, as defined in the appended claims.

What is claimed is:

1. A picture frame comprising a front frame member having a margin surrounding a picture opening; a segment of adhesive tape disposed on said margin around edges of the picture opening at a proximal side of said member; said adhesive tape having adhesive on both surfaces; a one-piece picture holder member bonded by said adhesive tape to said front frame member at the margin thereof and having a rectangular four-sided front member with a front flat surface that is held by said tape to said front frame member and a retaining wall portion formed on three sides of said rectangular front member with a fourth side being open; a transparent plate removably retained within said picture holder member; and a frame back which is insertable into said open fourth side and is removably retained within said picture holder member for holding a picture between said frame back and said transparent plate.

2. A picture frame according to claim 1 wherein said segment of adhesive tape is a rectangle of tape.

3. A picture frame according to claim 1 wherein said adhesive tape is foam double-sided tape.

4. A picture frame comprising a from frame member having a margin surrounding a frame member picture opening; a segment of adhesive tape disposed on said margin around edges of the picture opening at a proximal side of said member; said adhesive tape having adhesive on both surfaces; a picture holder member bonded by said adhesive tape to said front frame member at the margin thereof; and a frame back which is removably retained within said picture holder member, wherein said picture holder member includes a one-piece casting having a rectangular four-sided front member with a front flat surface that is held by said tape to four sides of said margin, and a retaining wall formed on three sides of said rectangular member with a fourth side open for receiving said frame back.

5. A picture frame according to claim 4 wherein said segment of said tape includes a rectangle of said tape adhering to said front flat surface.

6. A picture frame according to claim 4 wherein said rectangular member defines a front rectangular picture holder opening in said picture holder member, said picture holder opening being larger than said frame member picture opening so that a portion of said frame member serves as a front wall for said picture holder member.

7. A picture frame according to claim 4 wherein said fourth open side of the retaining wall of said picture holder member is disposed downwards, and said frame back includes an easel stand.

* * * * *

UNITED STATES PATENT AND TRADEMARK OFFICE

CERTIFICATE OF CORRECTION

PATENT NO. : 5,438,777

DATED : August 8, 1995

INVENTOR(S) : David Howell

It is certified that error appears in the above-indentified patent and that said Letters Patent is hereby corrected as shown below:

Column 4:

Claim 4, line 1
"from frame" should read
--front frame--

Signed and Sealed this

Tenth Day of October, 1995

*Attest:*

Bruce Lehman

BRUCE LEHMAN

*Attesting Officer*

*Commissioner of Patents and Trademarks*